US011363888B2

(12) United States Patent
Jun et al.

(10) Patent No.: US 11,363,888 B2
(45) Date of Patent: Jun. 21, 2022

(54) TILTABLE CHAIR

(71) Applicant: Chair Meister Co., Ltd., Gyeonggi-do (KR)

(72) Inventors: Jae Cheon Jun, Seoul (KR); Do Won Han, Gyeonggi-do (KR)

(73) Assignee: Chair Meister Co., Ltd.

( * ) Notice: Subject to any disclaimer, the term of this patent is extended or adjusted under 35 U.S.C. 154(b) by 0 days.

(21) Appl. No.: 17/214,384

(22) Filed: Mar. 26, 2021

(65) Prior Publication Data

US 2022/0125203 A1 Apr. 28, 2022

(30) Foreign Application Priority Data

Oct. 23, 2020 (KR) ..... 10-2020-0138570

(51) Int. Cl.

| | |
|---|---|
| ***A47C 9/00*** | (2006.01) |
| ***A47C 9/02*** | (2006.01) |
| ***A47C 3/025*** | (2006.01) |
| ***A47C 3/30*** | (2006.01) |
| ***A47C 3/026*** | (2006.01) |

(52) U.S. Cl.

CPC ..... *A47C 3/0255* (2013.01); *A47C 3/026* (2013.01); *A47C 3/30* (2013.01); *A47C 9/00* (2013.01); *A47C 9/007* (2013.01); *A47C 9/02* (2013.01)

(58) Field of Classification Search

CPC ..... A47C 3/0255; A47C 3/026; A47C 3/30; A47C 9/00; A47C 9/02; A47C 9/007

USPC ..... 297/314, 461

See application file for complete search history.

(56) References Cited

U.S. PATENT DOCUMENTS

| | | | | |
|---|---|---|---|---|
| 4,099,697 A * | 7/1978 | Von Schuckmann .. | A47C 9/025 297/314 X |
| 5,044,587 A * | 9/1991 | Degen ..... | A47C 9/002 108/150 |
| 6,003,944 A * | 12/1999 | Glockl ..... | A47C 7/004 297/314 X |
| 6,106,064 A * | 8/2000 | Hibberd ..... | A47C 9/025 297/314 X |
| 6,176,548 B1 * | 1/2001 | Thole ..... | A47C 9/002 297/329 |

(Continued)

FOREIGN PATENT DOCUMENTS

| | | |
|---|---|---|
| JP | 2007/268118 A | 10/2007 |
| KR | 101869729 B1 | 6/2018 |
| KR | 102082352 B1 | 2/2020 |

*Primary Examiner* — Rodney B White

(74) *Attorney, Agent, or Firm* — Blank Rome LLP

(57) ABSTRACT

A tiltable chair includes a fixing base having a tiltable housing. A gas cylinder inside the tiltable housing reciprocates in upward and downward directions. A seat plate is on top of the gas cylinder. And an elastic tiltable member is inside the fixing base accommodates a longitudinal lower part of the gas cylinder so the gas cylinder moves tiltably about a vertical axis to the bottom of the fixing base. A fixed frame is on the bottom of the fixing base, a coupling frame is inside the center portion of the fixed frame to accommodate the gas cylinder therein, and a rubber packing is between the fixed frame and the coupling frame and deformed elastically in every direction. The rubber packing has tilt concave grooves formed inward to a given depth from top and underside reduced in width toward the insides thereof to form inclined surfaces.

3 Claims, 4 Drawing Sheets

(56) References Cited

U.S. PATENT DOCUMENTS

| | | | | |
|---|---|---|---|---|
| 6,209,958 | B1 * | 4/2001 | Thole | A47C 3/026<br>297/325 |
| 6,601,818 | B1 * | 8/2003 | Larsen | A47C 9/002<br>267/141.5 |
| 7,100,983 | B1 * | 9/2006 | Gant | A47C 3/025<br>297/314 X |
| 7,547,067 | B2 * | 6/2009 | Keilhauer | A47C 3/02<br>297/313 |
| 8,075,056 | B2 * | 12/2011 | Glockl | A47C 9/002<br>297/313 X |
| 9,016,786 | B2 * | 4/2015 | Glockl | A47C 3/22<br>297/313 |
| 9,526,341 | B2 * | 12/2016 | Glöckl | A47C 3/025 |
| 9,763,520 | B1 * | 9/2017 | Pan | A47C 3/026 |
| 9,770,107 | B2 * | 9/2017 | Glöckl | A47C 7/004 |
| 9,839,296 | B2 * | 12/2017 | Ballendat | A47C 7/44 |
| 9,861,202 | B2 * | 1/2018 | Qi | A47C 3/0255 |
| 10,034,547 | B1 * | 7/2018 | Pan | A47C 3/0252 |
| 10,362,876 | B2 * | 7/2019 | Aono | A47C 7/004 |
| 10,376,071 | B2 * | 8/2019 | Patton | A47C 7/004 |
| 10,905,244 | B2 * | 2/2021 | Engell | A63B 21/00069 |
| 2006/0138840 | A1 | 6/2006 | Keilhauer et al. | |
| 2011/0175414 | A1 * | 7/2011 | Asbjornsen | A47C 9/002<br>297/313 X |

* cited by examiner

TILTABLE CHAIR

RELATED APPLICATION

This application claims the benefit of Korean Patent Application No. 10-2020-0138570, filed Oct. 23, 2020. The entire content of this application is hereby incorporated by reference.

TECHNICAL FIELD

The present invention relates to a tiltable chair, and more particularly, to a tiltable chair that is capable of moving a seat in an arbitrary direction according to load distribution generated from a posture of a sitter who sits on the seat.

BACKGROUND ART

[Project Identity Number] D202052
[Name of Government Department] Gyeonggi-do
[Research and Management Organization]-Gyeonggi Business & Science Accelerator Foundation
[Research Name] Gyeonggi Technology Development Project
[Research Project Name] Development of tilting mechanism apparatus capable of allowing seat to be tiltable in every direction
[Contribution Rate] 1/1
[Host Research Institute] Chair Meister Co., Ltd.
[Research Period] Feb. 1, 2020~May 31, 2021

Generally, one-person chairs without any supports for the back or arms are called stools, and in this case, there are various types of stools. Among them, recently, the chairs tiltable in an arbitrary direction have been introduced.

The tiltable chairs are largely classified into chairs with tilting means located on the underside of the seat and chairs with tilting means located on the floor surface (Please refer to prior art disclosed in Patent Document 1).

The chair as disclosed in the prior art is configured to have a seat fixedly located on top of a post into which a gas cylinder is inserted, a first swinging link to which the post is fixed (fitted), a board fixed to the first swinging link, a second swinging link rotatably supported against a base (foundation) in such a manner as to support the first swinging link in a perpendicular direction to the first swinging link to allow the first swinging link to be freely rotatable, and a plurality of coil springs tightly located between the board and the base.

However, tiltable chair of the prior art has the first swinging link and the second swinging link as common parts thereof and has six coil springs, so that the chair provides different senses of tilting according to tilting directions, is complicated in configuration, has a large number of parts, and is expensive. Besides, undesirably, the coil springs cause severe noise in a process of repeated tension and compression.

PRIOR ART DOCUMENT

Patent Document (Patent Document 1) Japanese Patent Application Laid-open No. 2007-268118

DISCLOSURE

Technical Problem

Accordingly, the present invention has been made in view of the above-mentioned problems occurring in the prior art, and it is an object of the present invention to provide a tiltable chair that is capable of improving a configuration thereof, thereby providing a chair product simple in configuration and in advance preventing the generation of noise when tilted.

It is another object of the present invention to provide a tiltable chair that is capable of regulating a movable tilting range to prevent the occurrence of safety accidents or damage on an elastic tiltable member thereof.

Technical Solution

To accomplish the above-mentioned objects, according to the present invention, there is provided a tiltable chair including: a fixing base having a tiltable housing disposed on an upward protruding dome-shaped center thereof in such a manner as to be movable in an arbitrary direction; a gas cylinder disposed inside the tiltable housing in such a manner as to be linearly reciprocated in upward and downward directions; a seat plate disposed on top of the gas cylinder; and an elastic tiltable member disposed inside the fixing base in such a manner as to accommodate a longitudinal lower part of the gas cylinder therein to allow the gas cylinder to move tiltably about vertical axis to the bottom of the fixing base, wherein the elastic tiltable member includes a fixed frame located on the bottom of the fixing base, a coupling frame located inside the center portion of the fixed frame to accommodate the gas cylinder therein, and a rubber packing located between the fixed frame and the coupling frame and deformed elastically in every direction, wherein the rubber packing has tilt concave grooves formed inward to a given depth from top and underside respectively in such a manner that the tilt concave grooves are reduced in width toward the insides thereof to thus form inclined surfaces.

According to the present invention, desirably, the rubber packing has first waveform coupling portions in which crests and roots are repeatedly formed on the inner peripheral surface of the rubber packing and a coupling groove concavely formed inward to a given depth from the outer peripheral surface of the rubber packing, the coupling frame has second waveform coupling portions formed on the outer peripheral surface thereof in such a manner as to correspond to the first waveform coupling portions, and the fixed frame has a coupling protrusion corresponding to the coupling groove.

According to the present invention, desirably, the rubber packing has reinforcing protrusions protruding from the outer peripheral surface thereof on the upper and lower sides of the coupling groove respectively, and the fixed frame has reinforcing grooves formed on the inner peripheral surface thereof in such a manner as to be coupled correspondingly to the reinforcing protrusions.

According to the present invention, desirably, the elastic tiltable member has a tilt regulation plate adapted to ensure a space in which the coupling frame is tiltable and to regulate a maximum tilt angle of the gas cylinder.

Advantageous Effects

According to the present, invention, the tiltable chair is configured to have the elastic tiltable member adapted to accommodate the longitudinal lower part of the gas cylinder therein, instead of a large number of coil springs complicated in structure in the prior art, so that the chair product can be made simple in structure, thereby preventing the generation of noise when the tiltable chair is tilted.

In addition, the tiltable chair according to the present invention is configured to have the elastic tiltable member with the first waveform coupling portions and the coupling groove formed on the inner and outer peripheral surfaces thereof respectively, thereby actively enhancing elastic displacement with respect to the tilting direction of the gas cylinder, improving tilting effectiveness, and greatly increasing fixing forces in the coupled positions.

Further, the tiltable chair according to the present invention is configured to have the elastic tiltable member with the tilt regulation plate, thereby stably securing the space in which the coupling frame is tiltable and efficiently regulating the maximum tilt angle of the gas cylinder.

MODE FOR INVENTION

Figure 1:
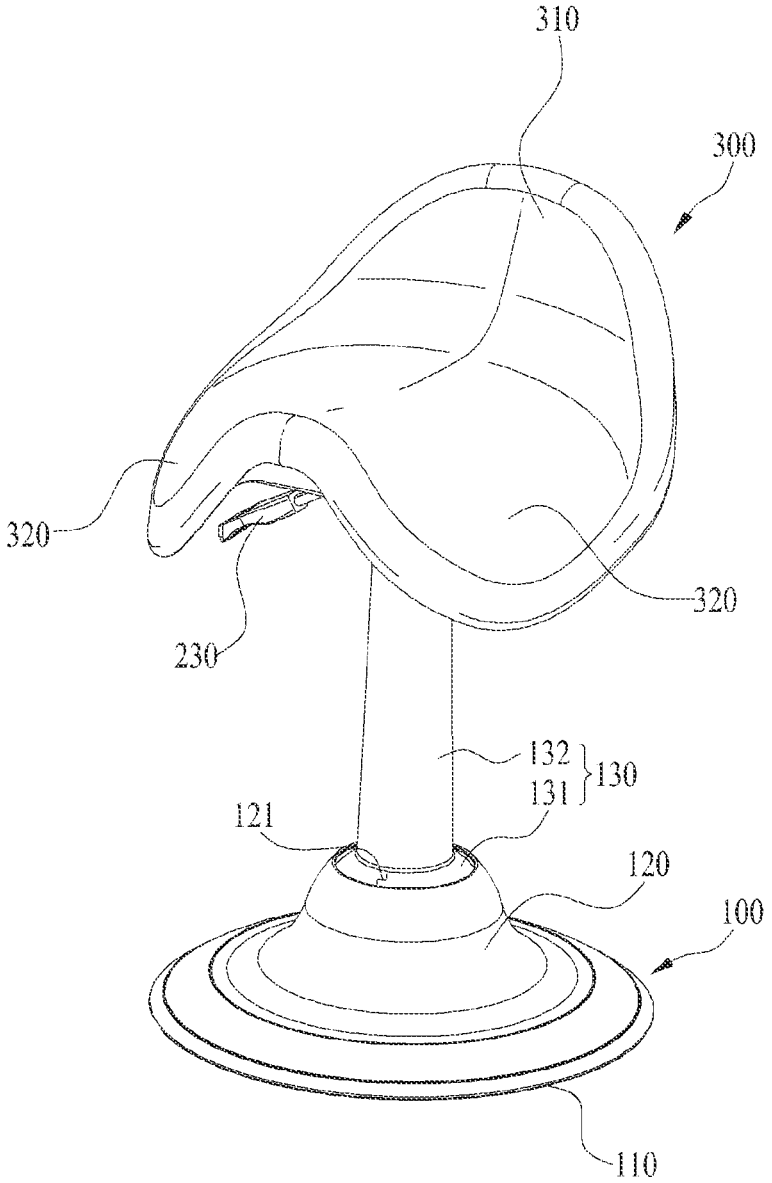
FIG. 1 is a perspective view showing a tiltable chair according to the present invention.
Figure 2:
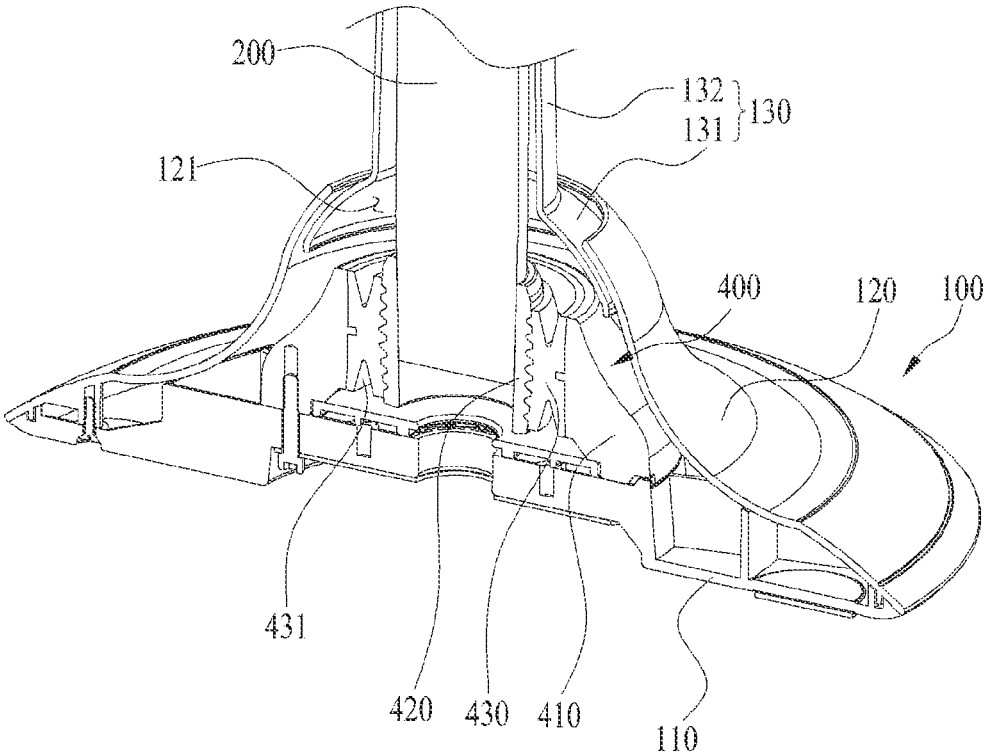
FIG. 2 is a partial sectional view showing the tiltable chair of FIG. 1.
Figure 3:
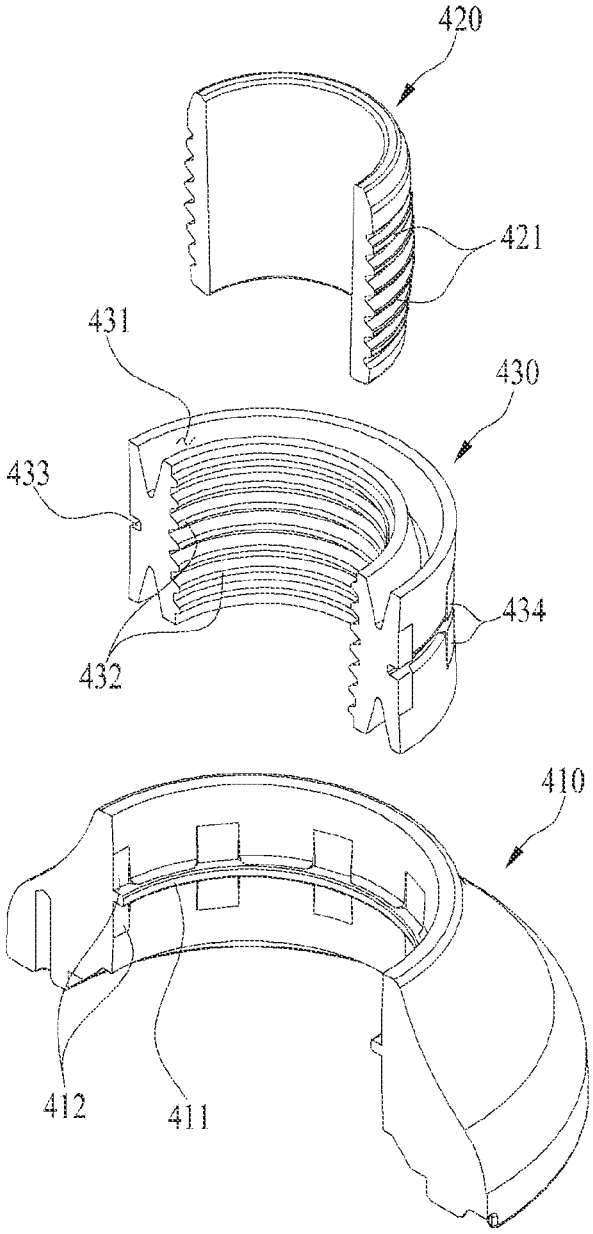
FIG. 3 is an exploded sectional view showing an elastic tiltable member of FIG. 2.

Hereinafter, an explanation on a tiltable chair according to the present invention will be in detail given with reference to the attached drawings.

For reference, terms and words used in the present specification and claims are not to be construed as being limited to their usual or dictionary meanings, and should be interpreted as a meaning and concept consistent with the technical idea of the present invention based on the principle that the inventor can appropriately define the concept of terms in order to describe the invention in the best way.

The present invention can be modified in various ways and can have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

Hereinafter, the present invention will be in detail explained with reference to FIGS. 1 to 4*b*.

As shown, a tiltable chair according to the present invention includes a fixing base 100 having a tillable housing 130 disposed on an upward protruding dome-shaped center thereof in such a manner as to be movable in an arbitrary direction, a gas cylinder 200 disposed inside the tiltable housing 130 in such a manner as to be linearly reciprocated in upward and downward directions, a seat plate 300 disposed on top of the gas cylinder 200, and an elastic tiltable member 400 disposed inside the fixing base 100 in such a manner as to accommodate a longitudinal lower part of the gas cylinder 200 therein to allow the gas cylinder 200 to be elastically movable in the arbitrary direction.

First, the fixing base 100, which has surface contact with ground, includes a first base 110 having a shape of a flat circular plate, a dome-shaped second base 120 coupled to top end periphery of the first base 110 in such a manner as to protrude upward from a central portion thereof and having a coupling hole 121 formed on a center thereof, and the tiltable housing 130 fitted to the coupling hole 121 of the second base 120 in such a manner as to be tiltable in the arbitrary direction.

The tiltable housing 130, which is extended to a given length, includes a curved coupling part 131 formed correspondingly to the curved shape of the inner peripheral surface of the coupling hole 121 of the second base 120 and a cylinder case 132 for accommodating the gas cylinder 200 therein.

Accordingly, the tiltable housing 130 prevents the gas cylinder 200 from being exposed directly to the outside, thereby safely protecting the gas cylinder 200 from external impacts and keeping dust or foreign substances from easily entering the elastic tiltable member 400 through the coupling hole 121 of the second base 120.

The gas cylinder 200 is erected inside the tiltable housing 130 and moves the seat plate 300 in upward and downward directions to adjust a height of the seat plate 300 from ground.

In specific, the gas cylinder 200 can adjust a position of the seat plate 300 in height in accordance with a physical condition of a sitter.

The gas cylinder 200 is configured and operated in the same or similar manner as or to the known technology in which a cylinder rod is moved up and down by means of a gas pressure applied by the operation of a control member 230 located separately, and accordingly, an explanation of the specific configuration and operation of the gas cylinder 200 will be avoided.

The seat plate 300 is disposed on top of the gas cylinder 200 to allow a user to conveniently sit thereon.

The seat plate 300 may have a cushion member for elastically supporting the sitter's hips.

According to the present invention, the seat plate 300 has a hip support stand 310 located on the rear side thereof to prevent the sitter's hips from pushing backward and inclined supports 320 located on the front thereof to allow the sitter's thighs to be inclined naturally toward ground by means of inclined angles thereof.

Further, the elastic tiltable member 400 is fixedly located inside the fixing base 100 and accommodates a longitudinal lower peripheral surface of the gas cylinder 200 therein to allow the gas cylinder 200 to be movable in the arbitrary direction in plan view.

That is, as the lower part of the gas cylinder 200 is fitted to the elastic tiltable member 400, the elastic tiltable member 400 elastically supporting the gas cylinder 200 is elastically changed in position in every direction in accordance with the sitter's postures on the seat plate 300 or the sitter's weight distribution, thereby tilting the seat plate 300.

If the sitter who sits on the seat plate 300 bends his or her body forward, for example, the elastic operation of the elastic tiltable member 400 allows the axial position of the gas cylinder 200 to move to the tilting direction of the changed posture of the sitter, thereby inducing his or her waist workout or keeping his or her right posture.

In specific, the elastic tiltable member 400 includes a fixed frame 410 fixedly located on the bottom of the fixing base 110, a coupling frame 420 located inside the center portion of the fixed frame 410 to accommodate the gas cylinder 200 therein, and a rubber packing 430 located between the fixed frame 410 and the coupling frame 420.

The rubber packing 430 is desirably made of a synthetic or natural rubber material, but it is not limited particularly thereto. Only if the rubber packing 430 may have sufficient elastic displacement, of course, it may be made of other resin materials like urethane, silicon, and so on.

Instead of a large number of coil springs complicated in structure in the conventional, practice, the rubber packing 430 is made of a resin material under a simple structure, so that when the tiltable chair is tilted, generation of noise can be prevented in advance.

According to the present invention, further, the rubber packing 430 has tilt concave grooves 431 formed inward to a given depth from top and underside of end peripheries thereof respectively, and the tilt concave grooves 431 become reduced in width toward the insides thereof to thus form inclined surfaces. That is, the tilt concave grooves 431 have a V shape.

The tilt concave grooves 431 formed on the rubber packing 430 enhance the elastic displacement of the rubber packing 430 so that the movable range in which the gas cylinder 200 is tiltable can be enlarged.

Further, the rubber packing 430 has first waveform coupling portions 432 in which crests and roots are repeatedly arranged formed on the inner peripheral surface thereof and a coupling groove 433 concavely formed inward to a given depth from the outer peripheral surface thereof.

Also, the coupling frame 420 has second waveform coupling portions 421 formed on the outer peripheral surface thereof in such a manner as to correspond to the first waveform coupling portions 432, and the fixed frame 410 has a coupling protrusion 411 corresponding to the coupling groove 433.

According to the present invention, like this, the rubber packing 430 has a coupling structure corresponding complementarily to the fixed frame 410 and the coupling frame 420, without any forced fitting to the fixed frame 410 and the coupling frame 420 or having any separate adhesive, thereby greatly improving fastening and fixing to the fixed frame 410 and the coupling frame 420 to enhance the reliability of the chair product.

Figure 4A:
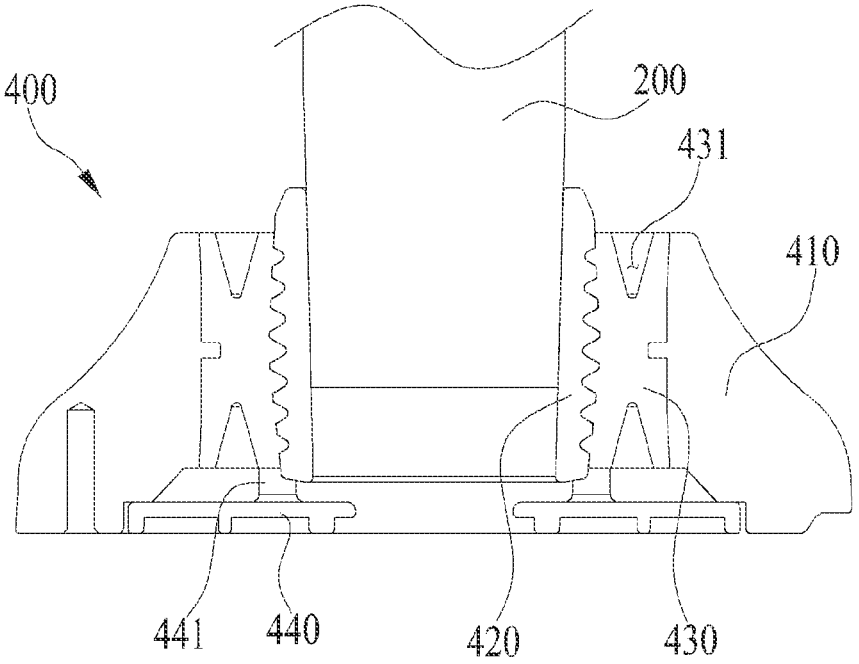
FIGS. 4*a* and 4*b* are partial sectional views showing the operations of the elastic tiltable member of FIG. 2.
Figure 4B:
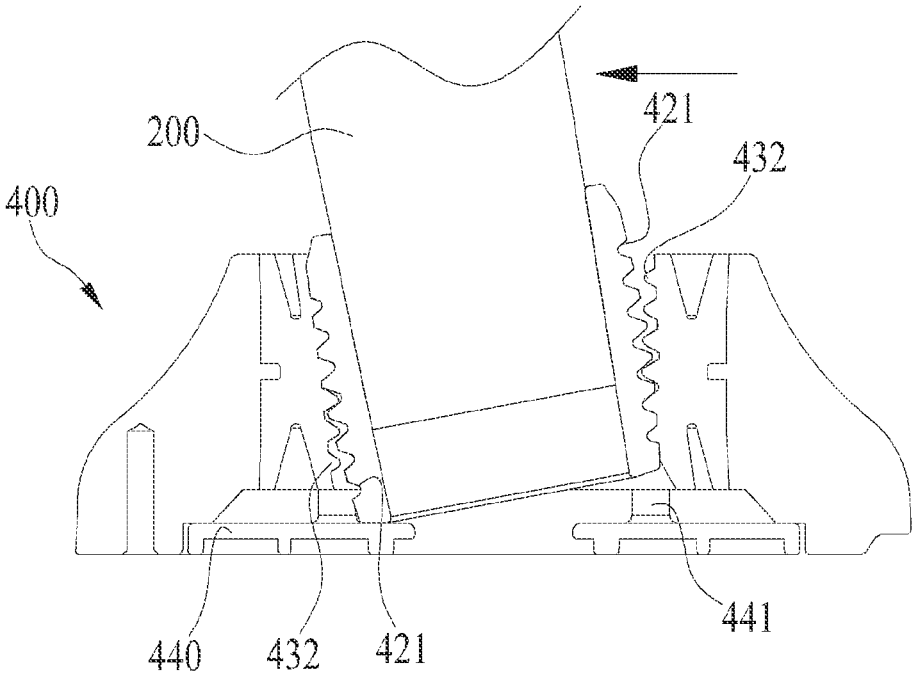

If the gas cylinder 200 is tilted toward one side, as shown in FIGS. 4*a* and 4*b*, one side upper part of the rubber packing 430 and the other side lower part of the rubber packing 430 in the opposite side thereto become compressed. In this case, the first waveform coupling portions 432 of one side lower part of the rubber packing 430 and the other side upper part thereof, which are not compressed, naturally escape from the coupling grooves 421 corresponding thereto in a direction distant from the coupling grooves 421, thereby more increasing variable deformation through which the rubber packing 430 is compressed.

Further, the rubber packing 430 has reinforcing protrusions 434 protruding upward and downward from the outer peripheral surface thereof in such a manner as to place the coupling groove 433 therebetween, and the fixed frame 410 has reinforcing grooves 412 formed on the inner peripheral surface thereof in such a manner as to be coupled correspondingly to the reinforcing protrusions 434.

That is, the reinforcing protrusions 434 and the reinforcing grooves 412 serve to enlarge the coupled surface area between the rubber packing 430 and the fixed frame 410 to stably improve the fixing force of the rubber packing 430.

Further, the elastic tiltable member 400 has a tilt regulation plate 440 adapted to ensure a space in which the coupling frame 420 is tiltable and to regulate a maximum tilt angle of the gas cylinder 200.

The tilt regulation plate 440 has a protruding boss 441 formed on top periphery thereof in such a manner as to come into contact with the fixed frame 410. That is, a space in which the coupling frame 420 is tiltable in upward and downward directions can be stably secured by means of the protruding boss 441.

Further, the tilt regulation plate 440 efficiently regulates the maximum tilt angle of the gas cylinder 200 by means of the contact interference with the coupling frame 420 in the process where the gas cylinder 200 is tilted toward one side.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A tiltable chair comprising:

a fixing base having a tiltable housing disposed on an upward protruding dome-shaped center thereof in such a manner as to be movable in an arbitrary direction;

a gas cylinder disposed inside the tiltable housing in such a manner as to be linearly reciprocated in upward and downward directions;

a seat plate disposed on top of the gas cylinder; and an elastic tiltable member disposed inside the fixing base in such a manner as to accommodate a longitudinal lower part of the gas cylinder therein to allow the gas cylinder to move tiltably about vertical axis to the bottom of the fixing base, wherein the elastic tiltable member comprises a fixed frame located on the bottom of the fixing base, a coupling frame located inside the center portion of the fixed frame to accommodate the gas cylinder therein, and a rubber packing located between the fixed frame and the coupling frame and deformed elastically in every direction, wherein the rubber packing has tilt concave grooves formed inward to a given depth from top and underside respectively in such a manner that the tilt concave grooves are reduced in width toward the insides thereof to thus form inclined surfaces, wherein the rubber packing has first waveform coupling portions in which crests and roots are repeatedly formed on an inner peripheral surface of the rubber packing and a coupling groove concavely formed inward to a given depth from an outer peripheral surface of the rubber packing, the coupling frame has second waveform coupling portions formed on an outer peripheral surface of the coupling frame in such a manner as to correspond to the first waveform coupling portions, and the fixed frame has a coupling protrusion corresponding to the coupling groove.

2. The tiltable chair according to claim 1, wherein the rubber packing has reinforcing protrusions protruding from the outer peripheral surface of the rubber packing on the upper and lower sides of the coupling groove respectively, and the fixed frame has reinforcing grooves formed on an inner peripheral surface of the fixed frame in such a manner as to be coupled correspondingly to the reinforcing protrusions.

3. The tiltable chair according to claim 1, wherein the elastic tiltable member has a tilt regulation plate adapted to ensure a space in which the coupling frame is tiltable and to regulate a maximum tilt angle of the gas cylinder.

* * * * *